United States Patent [19]

Britton

[11] Patent Number: 4,473,917

[45] Date of Patent: Oct. 2, 1984

[54] CLEANING OF BALLS

[75] Inventor: Rex J. Britton, Bristol, England

[73] Assignee: Kleeneze Brush Company Limited, England

[21] Appl. No.: 382,145

[22] Filed: May 26, 1982

[30] Foreign Application Priority Data

Jun. 3, 1981 [GB] United Kingdom ..... 8117076

[51] Int. Cl.[3] ..... A43B 47/04

[52] U.S. Cl. ..... 15/104.94; 15/21 A; 15/160

[58] Field of Search ..... 15/21 A, 104.92, 104.94, 15/160, 59, 65, 75, 76, 104.04, 164

[56] References Cited

U.S. PATENT DOCUMENTS

| | | | |
|---|---|---|---|
| 2,672,633 | 3/1954 | Allen . | |
| 2,672,637 | 3/1954 | Allen | 15/160 X |
| 2,822,558 | 2/1958 | Vandervort et al. . | |
| 3,221,355 | 12/1965 | Grommes | 15/160 |
| 3,378,873 | 4/1968 | Strout | 15/104.92 X |

FOREIGN PATENT DOCUMENTS

| | | | |
|---|---|---|---|
| 1183885 | 12/1964 | Fed. Rep. of Germany | 15/104.04 |

*Primary Examiner*—Edward L. Roberts

*Attorney, Agent, or Firm*—Ostrolenk, Faber, Gerb & Soffen

[57] ABSTRACT

A golf ball cleaning device comprises a cylindrical casing 1 lined with a helical strip of bristles 8. A cleaning pad 7 is provided in the casing base and a removable cap 11 at the top allows a ball to be inserted for cleaning.

4 Claims, 3 Drawing Figures

CLEANING OF BALLS

BACKGROUND OF THE INVENTION

This invention relates to the cleaning of balls, particularly golf balls. In order that a golf ball rolls true it has long been a recognized requirement that the ball should be clean and it is the object of the present invention to provide a simple device which enables a golf ball to be cleaned without the use of rags and without dirtying the hands of the user.

SUMMARY OF THE INVENTION

In accordance with the present invention a golf ball cleaning device comprises a tubular casing openable at one end to provide access, resiliently flexible cleaning elements extending radially inwardly into the casing and defining a passage of a diameter suitable for entry of the ball to be cleaned and, preferably a dispensing pad capable of holding cleaning liquid at at least one end of the passage.

The arrangement is that in use the ball is inserted into the passage and the casing closed and shaken. The ball moves longitudinally within the casing flexing the cleaning elements thereby cleaning the surface of the ball; abutment of the ball against the pad provides release of cleaning liquid to enhance the cleaning operation.

The resiliently flexible elements can conveniently be a helical extending strip of bristles. A helical mounting strip which fits inside the tubular casing holds the bristles.

BRIEF DESCRIPTION OF THE DRAWINGS

A particular embodiment of the invention will now be described by way of example and with reference to the accompanying drawings wherein.

DESCRIPTION OF THE PREFERRED EMBODIMENTS

Figure 1:
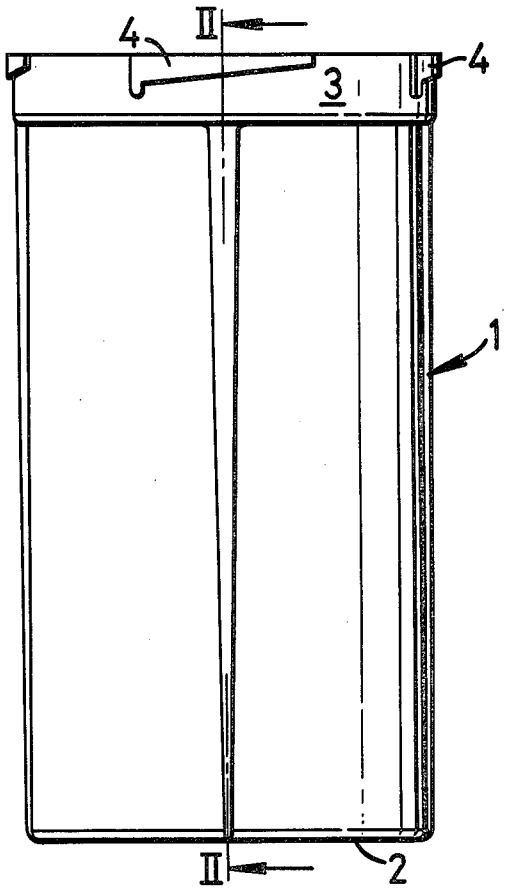
FIG. 1 is a side view of the device.
Figure 3:
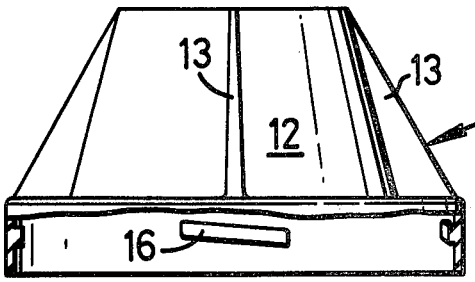
FIG. 3 is a side view, partly in section of the cap.

The device illustrated is formed of plastics and comprises a cylindrical casing 1 closed at the lower end to provide a base 2. The open end has an outwardly extending rim 3 from the upper part of which extend four inclined ramps 4 of a bayonet connection. A shallow radially inwardly extending rib 5 is positioned around the upper part of the rim and an annular shoulder 6 is provided below the rib 5. A disc shaped pad 7 of liquid-absorbent, for example foam, material fits the base of the container and a helically disposed strip of bristles 8 extends continuously from the pad 7 to seat on the shoulders 6 and be retained by a washer 9 retained under the rib 5. The bristles are held in a channel member 10 formed into the helix with the bristles 8 extending radially inwardly as shown in FIG. 2, the channel member 10 forms a helical mounting strip which fits inside casing 1.

Figure 2:
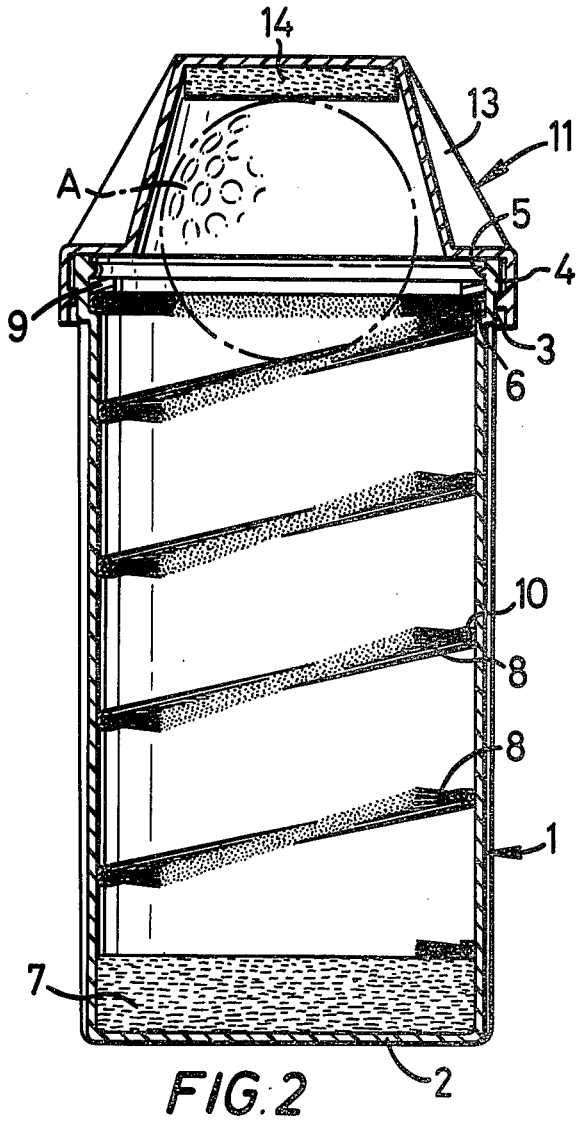
FIG. 2 is a section on the line II—II of FIG. 1 with the lid removed.

A cleaning passage is thus defined within the free ends of the bristles 8 having a diameter similar to a golf ball schematically indicated at A in FIG. 2.

The device is completed by a detachably engaged cap 11 having a frusto-conical head 12 with triangular ribs 13 to facilitate turning. A cleaning pad 14 of disc shape is located in the upper part of the cap. The cap 11 has a dependent rim 15 to fit over rim 3 of the casing 1, the inner surface of rim 15 having inclined projections 16 of the bayonet connection.

In use the cap is removed and the ball is inserted into the cleaning passage, the pads 7 and 14 having previously been moistened conveniently with water. The device is then shaken and rubbing action of the ball against the bristles 8 cleans the ball. The cap is then removed and the clean ball is ready for use.

I claim:

1. A golf ball cleaning device comprising:

a closed, tubular casing openable at one end to provide access;

a helical mounting strip fitting inside and at the inside of the tubular casing;

a helically disposed continuous strip of bristles mounted on the helical mounting strip;

the bristles extending inwardly from said strip and defining a passage of a diameter appropriate for cleaning engagement with the ball; and a dispensing pad capable of holding cleaning liquid at at least one end of the casing.

2. A golf ball cleaning device comprising:

a closed tubular casing openable at one end to provide access;

a helical mounting strip fitting inside and at the inside of the tubular casing;

a helically disposed continuous strip of bristles mounted on the helical mounting strip;

the bristles extending inwardly from said strip and defining a passage of a diameter appropriate for cleaning engagement with the ball; and a removable cap over the one openable end of the casing, the cap being lined with a dispensing pad capable of holding cleaning liquid.

3. A golf ball cleaning device comprising:

a closed, tubular casing openable at one end to provide access;

a helical mounting strip fitting inside and at the inside of the tubular casing; and a helically disposed continuous strip of bristles mounted on the helical mounting strip;

the bristles extending inwardly from said strip and defining a passage of a diameter appropriate for cleaning engagement with the ball.

4. A device as in claim 3 in which the helical mounting strip is a channel shaped member for holding the bristles, the channel shaped member being formed into a helix with the bristles extending radially inward.

* * * * *